US005468084A

United States Patent [19]

Boninsegni et al.

[11] Patent Number: 5,468,084

[45] Date of Patent: Nov. 21, 1995

[54] LIPSTICK WITH REPLACEABLE WAXSTICK CASE UNIT

[75] Inventors: Christian Boninsegni, Le Landeron, Switzerland; Hans-Georg Geike, Nuremberg, Germany

[73] Assignee: H. Huck GmbH & Co. KG, Nuremberg, Germany

[21] Appl. No.: 176,386

[22] Filed: Jan. 3, 1994

[30] Foreign Application Priority Data

Jan. 5, 1993 [DE] Germany ..... 43 00 089.4

[51] Int. Cl.[6] ..... A45D 40/04; A45D 40/16

[52] U.S. Cl. ..... 401/78; 401/73; 401/87; 401/98

[58] Field of Search ..... 401/78, 73, 98, 401/87

[56] References Cited

U.S. PATENT DOCUMENTS

| | | | |
|---|---|---|---|
| 1,632,765 | 6/1927 | Noble | 401/78 |
| 2,022,075 | 11/1935 | Cabrera | 401/78 |
| 2,815,123 | 12/1957 | Safianoff | 401/78 X |
| 3,124,245 | 3/1964 | Hopgood | 401/78 |
| 3,706,354 | 12/1972 | Gruska | 401/78 |
| 3,706,500 | 12/1972 | Gruska | 401/78 |
| 3,806,263 | 4/1974 | Webster | 401/78 |

FOREIGN PATENT DOCUMENTS

| | | | |
|---|---|---|---|
| 1052053 | 1/1954 | France | 401/78 |
| 539757 | 2/1956 | Italy | 401/78 |
| 1261975 | 2/1972 | United Kingdom | 401/78 |

*Primary Examiner*—Steven A. Bratlie
*Attorney, Agent, or Firm*—Anderson Kill Olick & Oshinsky

[57] ABSTRACT

A lipstick including a spiral tube having a spiral groove formed in its inner surface, a slotted sleeve with at least one axial slot and extending into the spiral tube for relative rotation thereto for enabling displacement in opposite directions of a case with a waxstick insertable into the sleeve and the tube and having a boss movable through the slot and engaging in the spiral groove upon insertion. The case with the waxstick, together with the stick cap, are formed as a single unit before being inserted into the lipstick mechanics.

7 Claims, 2 Drawing Sheets

LIPSTICK WITH REPLACEABLE WAXSTICK CASE UNIT

BACKGROUND OF THE INVENTION

The present invention relates to a lipstick with a replaceable waxstick and includes a spiral tube having an inner surface, a spiral groove formed in the inner surface and a slotted sleeve extending in the spiral tube for relative rotation thereto and having at least one axial slot. An end piece closes one end of the the spiral tube. A replaceable case for receiving a waxstick is inserted through the one end into the slotted sleeve and the spiral tube, when the end piece is removed. The case has at least one boss, movable through the at least one slot and engageable in the spiral groove upon insertion of the case, and a grip portion. The case is axially displaceable between two end positions. The grip portion, when the case is in its lower end position extends beyond the location of the end piece in the tube.

The present invention is not limited to lipstick, but also relates to means where the waxstick consists of a deodorant material or any other cosmetic material.

In the described lipstick, the waxstick is replaced together with the case, so that a continued use of the lipstick without the waxstick case and the waxstick (i.e, the mechanics of the lipstick), is possible with a plurality of cases and waxsticks. In this case, the waxsticks are available to the user together with the waxstick case, with the waxstick being fixedly secured in the case. The user has nothing to do with placing the waxstick in the case. When a waxstick is replaced, the case of a previous waxstick is thrown away. The replacement is effected in a simple manner— the end piece is manually removed by the user who then grips the grip portion of the case and withdraws it. The user then takes another case with a waxstick by its grip portion and inserts it into the slotted sleeve and the spiral tube. Thereafter, the user takes the end piece and closes the lipstick. The end piece serves as a stop for the case during the displacement thereof in the tube. The end piece can be secured in the tube by a clamp connection, a bayonet catch or snap connection.

French patent 1,051,382 discloses a lipstick of the above-described type in which the case with a waxstick before insertion remains totally unprotected. There is no disclosure of how the waxstick is made and is placed into the case. It can be possibly derived that the waxstick is made independently of the case and then is placed into the case. The grip portion of the case is formed by a tongue projecting from the closed bottom of the case. Manufacturing of waxsticks independently of cases and their subsequent insertion into the cases, involves additional costs. Further, the waxstick in this case remains unprotected until the case with the waxstick is inserted into the lipstick tube.

Accordingly, an important object of the invention is a lipstick in which a case unit, comprising a case with a waxstick and a stick cap for protecting the waxstick, is used.

SUMMARY OF THE INVENTION

This and other objects of the invention, which will become apparent thereafter, are achieved by providing an elongate cap, which is closed at one end, for covering a portion of the waxstick projecting from the case. The cap has an open end portion supported on the case. The case has a cup portion for form-injecting the waxstick into the case and the cap therethrough. The case with the waxstick and the cap together form a single unit which is formed before insertion into the slotted sleeve and spiral tube. The grip portion of the case is formed by an extension of the cup portion. The cup portion contains the waxstick which is injected thereinto through an opening formed in the bottom of the cup portion, which separate the cup portion so formed in the bottom of the cup portion, which separate the cup portion from the grip portion so that the grip portion is waxstick-free. The cap projects above the spiral tube when the unit is inserted into the tube.

Thus, the user would have available a case unit with a protective waxstick, with the waxstick being protected against any damage during insertion of the unit into the lipstick tube. The more stiff is the cap, the more is the waxstick protected against any damage. Usually, the waxstick protective cap is formed of a plastic material.

The protective cap has a circumferential resilient end strip which abuts the waxstick case. The end strip provides for better support of the cap on the case. When the case unit, with the waxstick and the waxstick cap, is inserted into the lipstick tube, the unit is moved therethrough until the cap projects above the tube. During the insertion, the end strip is pressed against the case by the tube wall, and expands above the tube. During the withdrawal movement of the case, the protective cap is taken off.

A novel feature of the invention is that the waxstick is form-injected into the cup portion of the case which is separated from the lipstick mechanics. The manufacturing of a waxstick directly in the case by injection of a plastic waxstick material is an important feature of the present invention. This method of manufacturing of waxsticks is especially cost effective.

In contrast to the prior art, there is no need for an auxiliary case and a waxstick protective cap is further provided. The novel features, according to the present invention, result in a lipstick comprising a waxstick case with a waxstick and a waxstick cap as an independent unit wherein the waxstick is protected not only after insertion of the case into the lipstick tube, but also before the insertion.

In an especially advantageous embodiment of the invention, the cup portion of the case, which serves for injection of the plastic material of which the waxstick is made, has an extension forming a grip portion of the case. This extension projects beyond the end piece position of the lipstick tube when the bosses of the case are located in the lower end of the spiral groove of the lipstick tube. This provides a simple means for manipulating the case and contributes to an improved shape of the case and the grip portion of the case. In the lipstick according to the present invention, the spiral tube and the slotted sleeve are so shaped that the waxstick is advanced from below. As a rule, the extension which forms the grip portion of the case, has a length at least equal to the length of the case itself.

The end piece, as a rule, is located in a base portion of the lipstick tube and which is clamped around the slotted sleeve which projects downward beyond the spiral tube. The waxstick, with the waxstick case in the full forward position, projects beyond both the spiral tube and the slotted sleeve forward.

It is especially advantageous, when the end piece and the base portion have cooperating thread regions for fixing the end piece in the base portion. The threaded connection substantially facilitates mounting and dismounting of the end piece.

It is further advantageous when the distance of the bosses on the case from the lower end of the case extension is larger than the axial length of the grip portion formed by the cup portion extension.

Still further, it is especially advantageous when the outer diameter of the case extension is smaller than the outer diameter of the cup portion of the case. The extension in the lipstick, according to the invention, does not have any contact with the lipstick mechanics and there is no frictional contact of the extension with the lipstick tube.

According to the invention, a set of case units with different waxsticks may be provided. In this way rather extensive lipstick mechanics can be used with a plurality of case units having, each a different waxstick.

According to the invention lipstick mechanics can be used with a plurality of pre-fabricated separate case units which can be easily manually replaced and in which the waxstick is reliably protected with a waxstick protective cap.

BRIEF DESCRIPTION OF THE DRAWINGS

The objects and features of the present invention will become more apparent, and the invention itself will be best understood from the following Detailed Description of the Preferred Embodiment, when read with reference to the accompanying drawings, wherein.

DETAILED DESCRIPTION OF THE PREFERRED EMBODIMENT

Figure 1:
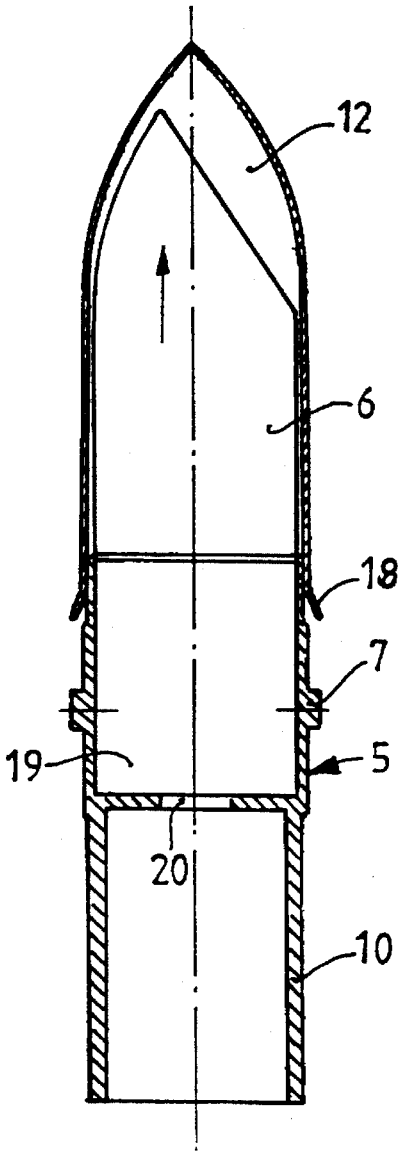
FIG. 1 shows a side cross-sectional view of a case unit of a lipstick according to the present invention comprising a case, a waxstick and a stick cap.
Figure 2:
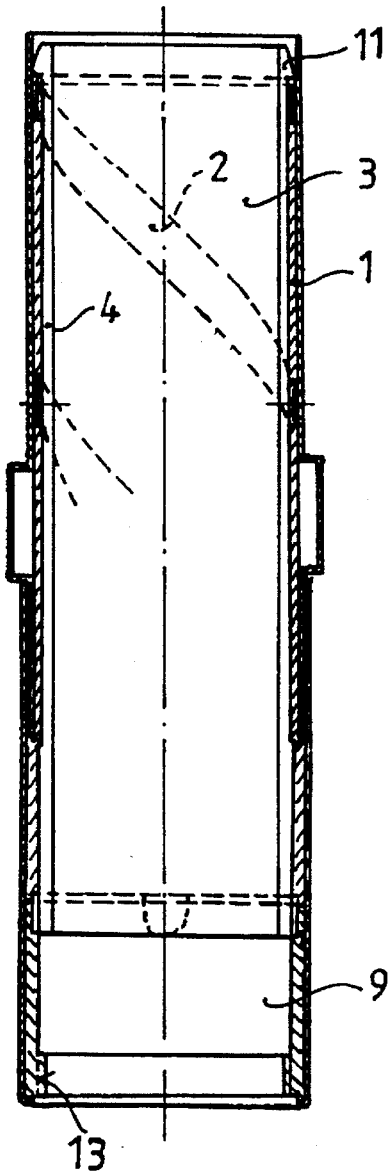
FIG. 2 shows a longitudinal cross-sectional view a portion of the lipstick.
Figure 3:
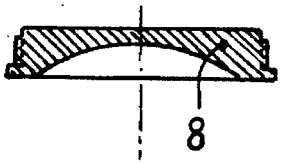
FIG. 3 shows a cross-sectional view of an end piece of the lipstick shown in FIGS. 1 and 2.
Figure 5:
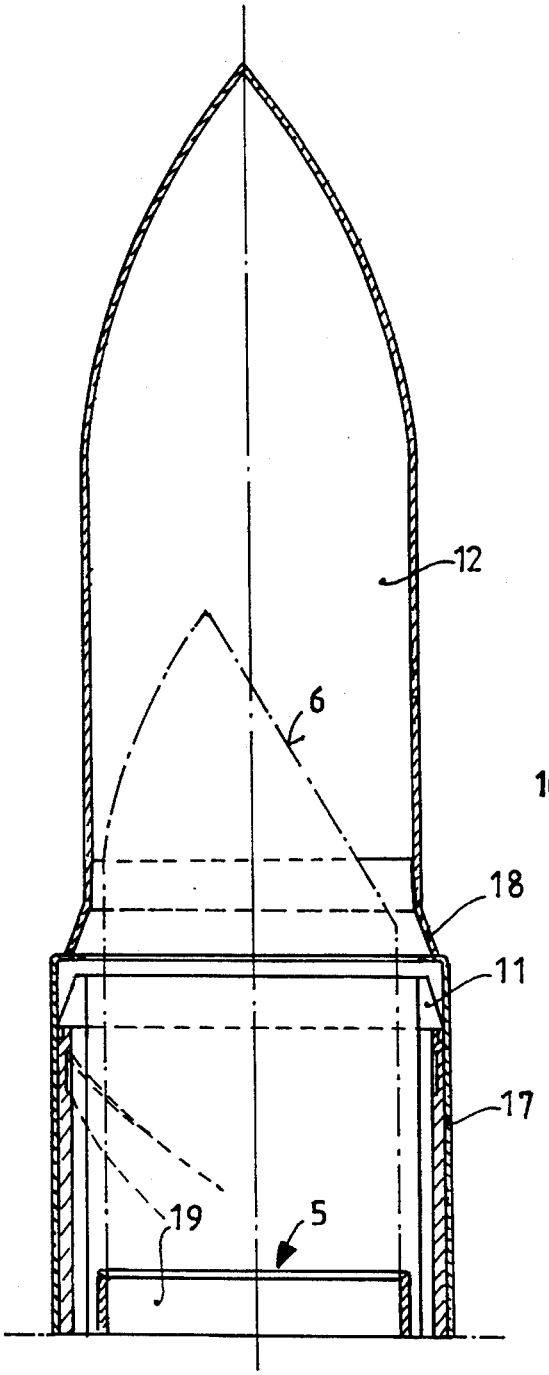
FIG. 5 shows an enlarged cross-sectional view of a lower portion of the lipstick shown in FIGS. 1–3.
Figure 4:
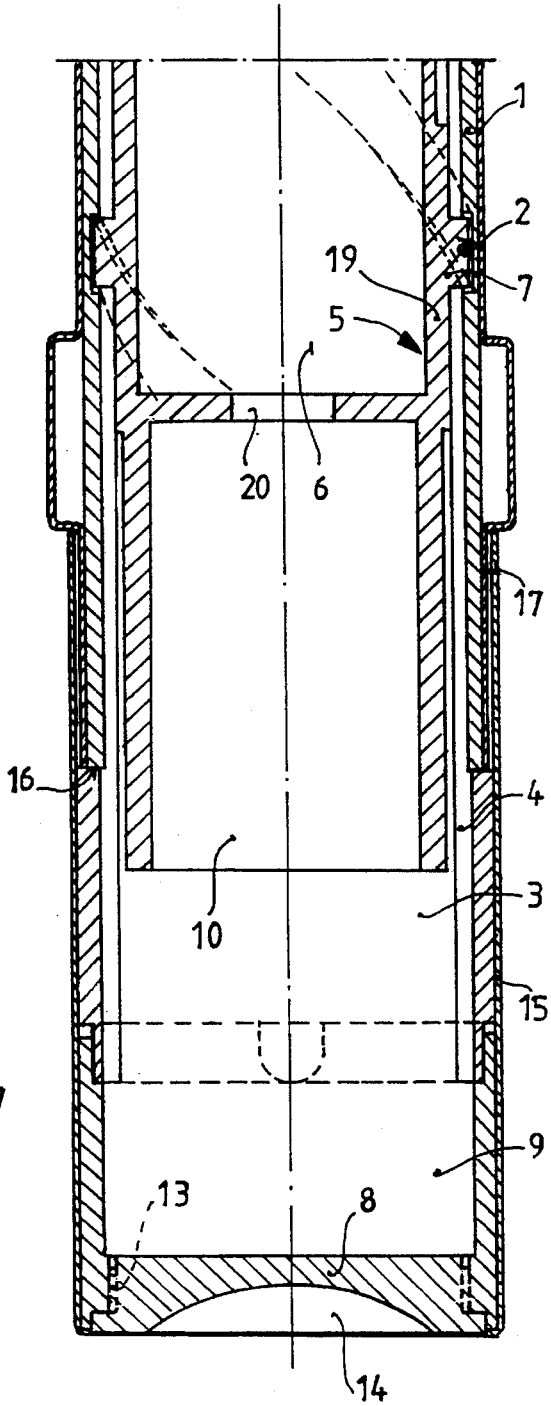
FIG. 4 shows an enlarged side cross-sectional view of an upper portion of the lipstick shown in FIGS. 1–3.

Referring now to the drawings, wherein like numerals reflect like elements throughout the various views, FIG. 2 shows a lipstick according to the present invention comprising a spiral tube 1, which is open at both ends and an inner surface of which is provided with a spiral groove 2. A slotted sleeve 3, which is provided with an axial slot 4 on each of two opposite sides thereof is supported in the spiral tube 1 for relative rotation thereto. A case 5 (see FIG. 1) with a waxstick 6 is provided with two radially outwardly extending bosses 7. The case 5 with the waxstick 6 is pushed into the slotted sleeve 3 and the spiral tube 1 from beneath so that bosses 7 slide through the slots 4 and engage in the spiral groove 2. Thereafter, an end piece 8 is mounted in a base portion 9 forming an extension of the spiral tube 1. Upon removal of the end piece 8, the case, together with the waxstick can be pulled out of the spiral tube 1.

By rotating the spiral tube 1 relative to the slotted sleeve 3, the case 5 with the waxstick 6 is moved in opposite directions. The spiral groove 2 ends at a predetermined distance from the front end of the base portion 9 and merges into a straight groove extending downward. The case 5 is provided with an axial grip portion 10, which serves as a grip handle, to facilitate insertion and removal of the case 5, together with the waxstick into and out of the spiral tube 1.

When the bosses 7 are at the lower end of the spiral groove 2, the grip portion 10 projects beyond the base portion 9, when the end piece 8 is removed. Stops 11, which are arranged at the upper end of the spiral groove 2, prevent the case 5 from being completely unscrewed forward. The waxstick 6 is provided with a protective cap 12.

The base portion 9 forms an extension of the spiral tube 1 and is clamped onto a portion of the slotted sleeve 3 which projects beyond the spiral sleeve 1. The base portion serves for rotating the slotted sleeve 3 relative to the spiral tube 1. The inner diameter of the base portion 9 is greater than that of the slotted sleeve 3, and the axial slots 4 end before the base portion 9. The end piece 8 has an outer thread 13 for engaging in the base portion 9 and has, at a bottom surface thereof, a slot 14 into which a coin, used as a simplified screwdriver, may be inserted for rotating the end piece 8. A metallic ornamental jacket 15 is mounted over the base portion 9 and an adjacent region of the slotted sleeve 3.

The spiral tube 1 ends before a shoulder 16 of the slotted sleeve 3 and likewise has a metallic ornamental jacket 17 thereon.

The spiral tube 1 is thus positioned between the upper stop 11 and the lower shoulder 16. The cap 12 has, at its lower end, a circumferential resilient end strip 18. The case 5 comprises a cup portion 19 which is formed integrally with the grip region 10 which forms an extension of the cup portion 19. An opening 20 is formed in the bottom of the cup portion 19 for injecting wax thereinto and into the protective cap 12 supported on the case 5.

While a particular embodiment of the invention has been shown and described, various modifications thereof will be apparent to those skilled in the art and, therefore, it is not intended that the invention be limited to the disclosed embodiment or to the details thereof and the departure may be made therefrom within the spirit and scope of the invention, as defined by the appended claims.

What is claimed is:

1. A lipstick, comprising:

spiral tube means having a front end, through which a waxstick extends during use, a rear end, an inner surface, and a spiral groove formed in said inner surface;

a slotted sleeve extending in said spiral tube means for relative rotation thereto and having at least one axial slot;

a removable end piece for closing the rear end of said spiral tube means; and a replaceable prefabricated waxstick unit insertable into said slotted sleeve when said end piece is removed, and axially displaceable between two end positions, one of said spiral tube means and said slotted sleeve including stop means for limiting displacement of said waxstick unit in a direction toward the front end of said spiral tube means, and said spiral groove and said axial slot being open at said rear end to enable insertion and removal of said waxstick unit, said waxstick unit comprising:

a waxstick;

a case for receiving the waxstick and having a cup portion for supporting said waxstick, at least one boss provided on said cup portion and extending through said at least one axial slot of said slotted sleeve and engageable in said spiral groove upon insertion of said waxstick unit for enabling the displacement of said waxstick unit between the two end positions upon rotation of said slotted sleeve relative said spiral tube means, and a grip portion for enabling the insertion and removal of said waxstick unit into and out of said slotted sleeve, said grip portion being formed as an extension of said cup portion; and a protection cap, closed at one end, for covering a portion of said waxstick projecting from said case, said protection cap having an open end portion supported on said case and defined by resilient end means, said resilient end means being compressed, upon the insertion of said waxstick unit through said slotted sleeve, and expanding upon complete displacement of said protection cap out of said slotted sleeve, said protection cap being assembled with said case and said waxstick being form-injected into said cup-portion of said case and said protection cap before the insertion of said waxstick unit into said slotted sleeve.

2. A lipstick as set forth in claim 1, wherein said boss is located a predetermined distance from an end of said grip portion.

3. A lipstick as set forth in claim 1, wherein said group portion has an outer diameter which is smaller than an outer diameter of said cup portion of said case.

4. A lipstick as set forth in claim 1, wherein said spiral tube means comprises a spiral tube and base portion spaced from said spiral tube and have one end thereof secured to an end of said slotted sleeve for rotating the same, and wherein said end piece has an outer thread cooperating with an inner thread, provided at an end of said base portion opposite to said one end, for removably securing said end piece in said base portion.

5. A lipstick as set forth in claim 1, wherein said resilient end means comprises a resilient end strip.

6. A lipstick as set forth in claim 1, wherein said cup portion has a bottom separating said cup portion from said grip portion, and an opening in said bottom through which the waxstick is form-injected into said cup portion, whereby said grip portion remains waxstick-free.

7. A lipstick set, comprising:

spiral tube means having a front end, through which a waxstick extends during use, a rear end, an inner surface, and a spiral groove formed in said inner surface;

a slotted sleeve extending in said spiral tube means for relative rotation thereto and having at least one axial slot;

a removable end piece for closing the rear end of said spiral tube means; and a set of replaceable prefabricated waxstick units interchangeably insertable into said slotted sleeve when said end piece is removed with each waxstick unit being axially displaceable between two end positions, one of said spiral tube means and said slotted sleeve including stop means for limiting displacement of the waxstick unit in a direction toward the front end of said spiral tube means, and said spiral groove and said axial slot being open at said rear end to enable insertion and removal of said waxstick unit, each waxstick unit comprising:

a waxstick;

an identical case for receiving the waxstick and having a cup portion for supporting said waxstick, at least one boss provided on said cup portion and extending through said at least one axial slot of said slotted sleeve and engageable in said spiral groove upon insertion of said waxstick unit for enabling the displacement of said waxstick unit between the two end positions upon rotation of said slotted sleeve relative said spiral tube means, and a grip portion for enabling the insertion and removal of said waxstick unit into and out of said slotted sleeve, said grip portion being formed as an extension of said cup portion; and an identical protection cap, closed at one end, for covering a portion of said waxstick projecting from said case, said protection cap having an open end portion supported on said case and defined by resilient end means, said resilient end means being compressed, upon the insertion of said waxstick unit through said slotted sleeve, and expanding upon complete displacement of said protection cap out of said slotted sleeve, said protection cap being assembled with said case and said waxstick being form-injected into said cup-portion of said case and said protection cap before the insertion of said waxstick unit into said slotted sleeve.

* * * * *